US006037280A

United States Patent [19]

Edwards et al.

[11] Patent Number: 6,037,280

[45] Date of Patent: Mar. 14, 2000

[54] ULTRAVIOLET RAY (UV) BLOCKING TEXTILE CONTAINING PARTICLES

[75] Inventors: Stuart D. Edwards; Kelly Edwards, both of Portola Valley; Theodore L. Parker, Danville; John M. Evans, Fremont, all of Calif.

[73] Assignee: Koala Konnection, Sunnyvale, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/921,975

[22] Filed: Sep. 2, 1997

Related U.S. Application Data

[60] Provisional application No. 60/041,343, Mar. 21, 1997.

[51] Int. Cl.[7] ..... B32B 5/28; B32B 5/30; B05B 5/00

[52] U.S. Cl. ..... 442/131; 442/133; 428/143; 428/913; 139/383 R; 427/160

[58] Field of Search ..... 442/131, 132, 442/133; 428/913, 143, 147, 148; 139/383 R; 427/160

[56] References Cited

U.S. PATENT DOCUMENTS

| | | | |
|---|---|---|---|
| 3,951,899 | 4/1976 | Seiner | 260/29.6 |
| 4,316,931 | 2/1982 | Tischer et al. | 442/131 X |
| 4,347,284 | 8/1982 | Tsutomu et al. | 428/328 |
| 4,554,198 | 11/1985 | von Blucher et al. | 428/143 |
| 4,861,651 | 8/1989 | Goldenhersh | 442/131 X |
| 4,861,664 | 8/1989 | Goossens et al. | 427/160 X |
| 5,134,025 | 7/1992 | Zenda et al. | 428/317.9 |
| 5,414,913 | 5/1995 | Hughes | 26/29 P |
| 5,503,917 | 4/1996 | Hughes | 428/229 |
| 5,635,252 | 6/1997 | Fraser, Jr. et al. . | |
| 5,637,348 | 6/1997 | Thompson et al. | 427/160 |

FOREIGN PATENT DOCUMENTS

| | | | |
|---|---|---|---|
| 42427/93 | 12/1993 | Australia | D06C 11/00 |
| 0 357 179 | 3/1990 | European Pat. Off. . | |
| 0 659 877 A2 | 6/1995 | European Pat. Off. | C11D 3/42 |
| 0 682 145 A2 | 11/1995 | European Pat. Off. | D06L 3/12 |
| 0 683 264 A2 | 11/1995 | European Pat. Off. | D06M 13/352 |
| 0 693 483 A1 | 1/1996 | European Pat. Off. | C07D 251/24 |
| 0 659 877 A3 | 3/1996 | European Pat. Off. | C11D 3/42 |
| 0 707 002 A1 | 4/1996 | European Pat. Off. | C07D 251/50 |
| 0 708 197 A2 | 4/1996 | European Pat. Off. | D06M 13/473 |
| 0 683 264 A3 | 8/1996 | European Pat. Off. | D06M 13/352 |
| 0 708 197 A3 | 8/1996 | European Pat. Off. | D06M 13/352 |
| 0 257 800 | 3/1998 | European Pat. Off. . | |
| 19600692 A1 | 7/1996 | Germany | D06P 3/66 |
| 19606840 A1 | 8/1996 | Germany | D06P 3/62 |
| 19613251 A1 | 10/1996 | Germany | D06P 3/60 |
| 1963671 A1 | 10/1996 | Germany | D06P 3/60 |
| 002064355 | 2/1980 | Japan . | |
| 002064359 | 1/1986 | Japan . | |
| 002064356 | 6/1986 | Japan . | |
| 002064354 | 8/1989 | Japan . | |
| 002064360 | 9/1989 | Japan . | |
| 002064358 | 11/1991 | Japan . | |
| 002064357 | 6/1995 | Japan . | |
| 575379 | 5/1941 | United Kingdom . | |
| 895746 | 5/1962 | United Kingdom . | |
| 2 289 290 | 11/1995 | United Kingdom | C11D 3/42 |
| 2 298 422 | 9/1996 | United Kingdom | C07D 403/12 |
| WO94/04515 | 3/1994 | WIPO | C07D 251/44 |
| WO94/17135 | 8/1994 | WIPO | C08K 5/00 |
| WO96/25549 | 8/1996 | WIPO | D06P 1/642 |

OTHER PUBLICATIONS

Micapoly™ UV Cristal Product Specification Sheet (Aug. 8, 1995).

Aug. 1996 Formulary (p.2: Lipstick with Micapoly UV Shadow).

May 1997 Formulary Sunscreen Emulsion with Micapoly UV Cristal.

*Primary Examiner*—Daniel Zirker

*Attorney, Agent, or Firm*—Ryan Kromholz & Manion, S.C.

[57] ABSTRACT

A UV blocking fabric is provided which includes a fabric, UV blocking particles having a property of deflecting, reflecting, absorbing and/or scattering ultraviolet rays; and a binding agent attaching the UV blocking particles to the fabric. An article of manufacture which includes a fabric, optionally shaped to form an article of clothing, an awning, an umbrella, a sunscreen, a tent, a tarp, a canvas and the like, UV blocking particles having a property of deflecting, reflecting, absorbing and/or scattering ultraviolet rays which may be colored to match or contrast with the color of the fabric; and a binding agent attaching the UV blocking particles to the fabric. The UV blocking particles may be applied to the article of manufacture prior to or after manufacturing the article by immersion methods or by spraying methods.

28 Claims, No Drawings

ULTRAVIOLET RAY (UV) BLOCKING TEXTILE CONTAINING PARTICLES

RELATIONSHIP TO COPENDING APPLICATION

The application is a continuation-in-part of ULTRAVIOLET RAY (UV) BLOCKING TEXTILE CONTAINING PARTICLES," Provisional Application Ser. No.: 60/041,343; filed: Mar. 21, 1997 which is incorporated herein by reference.

FIELD OF THE INVENTION

The present invention relates to a fabric having enhanced ultraviolet light (UV) blocking properties and more particularly a fabric containing particles which act to reduce the amount of UV light traversing the fabric.

BACKGROUND OF THE INVENTION

Protecting individuals from sunlight is important due to the deleterious cosmetic and medical effects of sunlight on the skin and subcutaneous tissues, both immediately after exposure and after prolonged and/or repeated exposure. Immediately, sunlight can cause reddening with an accompanying painful sunburn. Over time, repeated exposure to sunlight can cause premature aging of the skin and a loss of elastic quality.

Medically, sunlight is a contributing factor to the development of diseases such as melanoma and squamous and basal cell carcinomas. Probably the most common type of longer term damage is basal cell carcinoma which, although seldom fatal, can be disfiguring and requires medical attention. Another somewhat less common disease resulting from sun exposure is squamous cell carcinoma. Although also generally non fatal, squamous cell carcinoma can spread through the body if left untreated. The most deadly and feared cancer associated with sun exposure is malignant melanoma which spreads to other parts of the body unless detected and treated at an early stage of the disease.

Xeroderma pigmentosum is a rare pigmentary and atrophic autosomal recessive disease which causes extreme cutaneous photosensitivity to ultraviolet light and affects all races. This disease requires highly undesirable precautions to prevent exposure to light to the extent of remaining indoors in darkened rooms.

The components of sunlight that have been identified as causing deleterious medical effects are wavelengths in the ultraviolet spectrum, UVA (320–400 nm), UVB (280–320 nm) and UVC (200–280 nm). Both the UVA and UVB ranges have been found to contribute to skin damage. The UVC component of sunlight also causes deleterious medical effects but is largely removed by the ozone layer. However, UVC is likely to become a greater threat as the ozone layer is depleted.

Fabrics have been designed which reduce the transmission of the UVA and UVB radiation, e.g. U.S. Pat. Nos. 5,414,913 and 5,503,917. Some fabrics made with a tightly woven fabric will reduce the transmission of UV radiation.

Dyes have also been developed for increasing the SPF rating of fabric. Examples of patents and patent applications describing such dyes include U.S. Pat. No. 5,637,348; published PCT applications WO 9625549, WO 9417135, and WO 9404515; published British applications GB 2298422 and GB 2289290; published German applications DE 19613671, DE 19613251, DE 19606840, and DE 19600692; and published European applications EP 708197, EP 707002, EP 693483, EP 682145, EP 683264, and EP 659877.

U.S. Pat. No. 5,134,025 discloses the use of particles for the sole use of reflecting UV rays, in particular as an aid to creating a suntan rather than minimizing UV exposure as in the sun protective clothing application.

A need exists for ways to protect people from UVA, UVB and UVC light rays. UV protection should be easy and unobtrusive for an individual to use. UV protection should also be inexpensive to implement.

SUMMARY OF THE INVENTION

The present invention relates to a UV blocking fabric which includes a fabric, UV blocking particles having a property of deflecting, reflecting, absorbing and/or scattering ultraviolet rays; and a binding agent attaching the UV blocking particles to the fabric, which itself may or may not also include or inherently be a soluble UV blocker. The present invention also relates to an article of manufacture which includes a fabric, optionally shaped to form an article of clothing, an awning, an umbrella, a sunscreen, a tent, a tarp, a canvas and the like; UV blocking particles having a property of deflecting, reflecting, absorbing and/or scattering ultraviolet rays; and a binding agent attaching the UV blocking particles to the fabric.

The UV blocking fabric and article of manufacture preferably have an SPF value of at least 25. The UV blocking fabric and article of manufacture also preferably attenuate UV light traversing the fabric by a factor of at least two as compared to fabric which does not include the UV blocking particles, more preferably by a factor of at least three.

Examples of fabrics that can be used include, but are not limited to nylons, acrylics, acetates, polyesters, Dacron, Lycra, Spandex, cotton, rayon, wool, silk, polyethylene and polypropylene.

The UV blocking particles may be inorganic, organic or metallic. Examples of particles that may be used include, but are not limited to muscovite, phlogopite, biotite, sericite, fushitite, margarite, synthetic mica, metal oxide coated mica, colored pigment coated mica, talc, metal oxides, metallic hydroxides, mixed metal oxides and hydroxides, metal and mixed metal silicates and aluminosilicates, transition metal oxides and hydroxides, $ZrO_2$, $Fe_2O_3$, natural clay, metal sulfides, non- metallic elements, ionic salts and covalent salts, powdered ceramics, organic polymers, natural polymers, insoluble organic materials and biomaterials, particularly UV absorbing molecules, aluminum, copper, copper-bronze, bronze gold, silver and collagen. The UV blocking particles preferably have an aspect ratio of at least two, more preferably at least ten, and are preferably flat or scaly in shape. The UV blocking particles have a size of at least 5 nm, preferably at least 6 microns, and more preferably at least 15 microns.

A binding agent may be used to bind the particle to the fabric. Examples of suitable binding agents include, but are not limited to casein isolate, soy protein isolate, starch, starch derivatives, gums and synthetic latexes.

The UV blocking particles are attached within interstitial spaces within the fabric. The UV blocking particles may also be attached to a surface of the fabric. Alternatively, the UV blocking particles may be incorporated into the body of the fabric, more preferably encased within material.

The UV blocking particles forming the fabric may or may not also be incorporated into printing medium for fabrics. Depending upon the colorants used in the printing media, the UV absorbing particles would enhance the amount of blocking derived from the print. Additionally, the UV blocking particles would also inhibit the "fading" of the printed media.

The UV blocking particles and associated binder may be applied to the fabric by several methods. A suspension of particles and binder in a neutral solvent such as water may be applied to the fabric prior to garment manufacture or else applied after the garment is finished. The UV blocking particles and binder may also be applied to fabrics using finishing techniques known to the industry. The UV blocking particles and binder may also be applied using a spray or dip coating, soaking, or similar method to finished garments. Additionally, the particles and binder may be applied during the washing or laundering of clothing, e.g. at the rinse cycle. Prior to its addition, the particles may be in tablet form, delivered from a sachet, bottle, tube, such as a salve, or other mechanisms for delivering the particles and/or binder in a concentrated form, such as a paste.

DETAILED DESCRIPTION OF THE PREFERRED EMBODIMENT

The present invention relates to a fabric which includes UV blocking particles and a binding agent for retaining the UV blocking particles in the fabric. In general, the fabric of the present invention may be used to insulate life forms such as humans, animals and plants from the deleterious effects of UV radiation, particularly UV radiation contained in the natural spectral output of the sun. By incorporating the UV blocking particles into the fabric, the fabric transmits a lower percentage of UV light than the same fabric without the UV blocking particles. The UV blocking property of the fabric of the present invention arises from the deflection, reflection, absorption and/or scattering of ultraviolet rays having wavelengths between 280 and 400 nm by the UV blocking particles incorporated into the fabric.

In a preferred embodiment, the fabric provides a UV protection SPF value of greater than 25. In another preferred embodiment, the inclusion of the UV blocking particles into the fabric attenuates the amount of UV light that traverses the fabric by a factor of at least two and preferably by a factor of at least three.

The fabric of the present invention can be sewn or fabricated by standard techniques into a wide variety of articles of clothing, awnings, sunscreens, umbrellas, tents, tarps and the like. For example, the fabric can be used to form articles of clothing, such as sportswear and bathing suits, that have increased UV blocking ability at any given cloth thickness than the analogous article of clothing without the UV blocking particulates included. Additionally, the fabric can be used in military uniforms, astronauts' attire, protective safety garments, harsh environment garments, such as desert and arctic climes, for specific medical indications such as xeroderma pigmentosa, outdoor tarps, canvases, awnings, screens, umbrellas and the like, tents, camouflage nets, convertible car roofs, car upholstery, baby carriage covers, architectural structures, plant nursery and agricultural soft goods and screens.

The UV protective fabric of the present invention is preferably designed to have substantially the same feel as the same fabric that does not contain the UV blocking particles. For example, the fabric is not stiff or boardy.

The UV protective fabric of the present invention is preferably designed to maintain the color and visual texture of the fabric before treatment. UV absorbing particles may be chosen that match the color of the fabric or, alternatively, coloring agents may be used to match the color of the UV absorbing particles with the color of the fabric.

Types of materials that may be used to form the fabric of the present invention include any form of material which can be used to form any of the above described articles. Standard fibers, yarns and tows such as nylons, polyesters, acetates, acrylics, Dacron, Lycra, Spandex, cotton, rayon, wool, and silk may be used to form the fabric. In addition, air spun/spun bonded non-woven fabrics such as polyethylene, polypropylene may also be used to form the fabric.

The fabric may be woven or non-woven, but porous. The fabric may be formed of fibers, threads, tows and yarns, or air spun or spun bonded synthetic polymeric materials, which has accessible interstitial spaces formed by and between the surfaces of the woven or non-woven components. When used in respect to the fabrication method and the entwined network formed thereby, the term "woven" is intended to include any process and product whereby individual threads, fibers, fiber bundles or fiber tows are intertwined into a two or three dimensional network. Thus, the term "woven" includes weaving, knitting, etc.

UV blocking particles that may be used in the fabric of the present invention are particles which attenuate the amount of UV light which traverses the fabric when incorporated into the fabric. The UV blocking particles preferably attenuate the UV light by a factor of at least two and preferably by a factor of at least three relative to fabric without the UV blocking particles.

The UV blocking particles may be inorganic, in organic or metallic origin, including natural, biochemical or biological materials. Examples of inorganic UV blocking particles that may be used include, but are not limited to, natural mica, e.g. muscovite, phlogopite, biotite, sericite, fushitite, margarite; synthetic mica; metal oxide coated mica; colored pigment coated mica; talc; metal oxides or hydroxides, e.g. $TiO_2$, ZnO, $Al_2O_3$; mixed metal oxides and hydroxides; metal and mixed metal silicates and aluminosilicates; transition metal oxides and hydroxides, $ZrO_2$, $Fe_2O_3$; natural clay, e.g. attapulgite, montmarillonite, wallastonite, bentonite, mullite, kaolin, dolomite, repiolite; garnet; metal chalconides, e.g. metal sulfides such as Zn; non-metallic elements and molecules, e.g. amorphous C, crystalline C (diamond), graphite, $S_8$, Si; ionic salts and covalent salts, powdered ceramics. The above-mentioned particles may be used individually or in any combination.

Examples of organic UV blocking particles that may be used include, but are not limited to, organic polymers, preferably organic polymers containing aromatic chemical structures such as Bisphenol A polycarbonate (PC,) and polyethyleneterephthalate (PET, Dacron, Mylar). Additionally, organic polymers that do not contain aromatic structures but have been imbibed with a UV absorbing dye, such as poly(diethyleneglycol bis allyl carbonate), known as CR-39 from PPG Industries, imbibed with UV absorbing dyes from BPI, Inc., can be used. Collagen can also be used as a UV absorbing agent in addition to other biomaterials such as melatonin.

Examples of metallic UV blocking particles that may be used include, but are not limited to, aluminum, copper, copper-bronze, bronze gold and silver.

The UV blocking particles preferably have an aspect ratio of over two, more preferably over ten. In a further preferred embodiment, the UV blocking particles are flat or scaly in shape. The UV blocking particles have a size of at least 5 nm and preferably of at least 6 microns, more preferably at least 15 microns.

The UV blocking particles may reside predominantly in interstitial spaces of the fabric. For example, in woven fabrics, the UV blocking particles may be in the spaces between fibers. In the case of non-woven fabrics, the UV blocking particles may be in the pores of the fabric.

The UV blocking particles may also reside on the surface of individual fibers or threads of the fabric. This may be accomplished, for example, by painting or coating the UV blocking particles onto the surface of the fabric.

The UV blocking particles may also be incorporated into the fibers or material used to form the fabric. For example, in the case of woven fabric, the fibers or threads used to form the fabric may have the particles intertwined within the fabric. Alternatively, the material used to form the fibers or thread may be formed, in part, of the particles. Methods for constructing fabrics of the present invention are discussed in greater detail herein.

The UV blocking particles are preferably retained within the fabric using a binding agent. The fabric should retain its UV blocking ability after washing, such as in a washing machine. Because conventional washing aids, such as detergent formulations, are designed to remove soil from fabrics, the binding agent should be resistant to common laundry detergents so that particles in the fabric are retained after washing.

Examples of binders that may be used in water-based systems are proteins, such as casein and soy protein isolate, starches and starch derivatives such as dextrin, gums such as agarose and galactomannans, chitosan, sodium alginate, natural rubber and synthetic latexes, such as styrenebutadiene latexes, acrylic latexes, synthetic elastomer emulsions, e.g. siloxanes.

The binder may be incorporated onto the fabric by mixing the UV blocking particles in a fluidic medium, preferably aqueous, slurry, emulsion or suspension composition. Individual threads, fibers, fiber bundles, fiber tows, yarns, etc., can then be passed through the fluidic medium such that the particles are introduced onto and/or into the fibers and fiber assemblies used to form the fabric.

Various processing aids such as dispersants, flocculants, wetting agents, surfactants, etc., may be used to formulate workable compositions for introducing the UV blocking particulates and binder onto and/or into individual fibers and fiber assemblies. Although the methods described above are most suitable for introducing the desired compositions prior to conversion to the textile fabric, similar or modified methods can be employed to treat already formed textile fabric to confer the desired UV blocking properties of the invention. Examples of such methods from industry include dip coating, spray coating, curtain coating, roll coating, imprimateur coating, and powder (electrostatic) coating. Examples of such methods from consumer applications include aerosol spray coating, pump spray coating, exposure to a concentrate during a washing machine rinse cycle, exposure to a concentrate in a clothes dryer, dip coating, and impregnation in a semi-solid or solid.

The UV blocking particles may also be incorporated into the pre-woven yarns and tows through a method analogous to powder impregnation used in the aerospace industry. The fiber tow is spread, for example mechanically or by an air jet, then the particulate is introduced and the tow closed, entrapping the particulate. The particulate powder may be incorporated as a spray, in a fluidized bed, under ultrasonic agitation, or as an aqueous or non-aqueous slurry. In wet methods, particulate dispersant and/or flocculation additives may be required. Optionally, a latex is included in the aqueous slurry that will serve as an adhesive for the sun blocking particle to some fiber surfaces in the interstitial environment.

The UV blocking particles may also be incorporated into the body of the fiber itself by mixing the particulate component with the fiber forming material before fiber spinning. This approach is particularly useful where the fabric is formed of chemically made fibers such as acrylics, polyesters, Dacron, nylons, rayon and the like. Subsequent weaving of fibers produced according to this method produce a fabric where the UV blocking particles are encased within the fibers. This embodiment provides the advantage of reducing the tendency of the UV blocking particles of being washed out of the fabric. In this embodiment, the fiber forming material may serve as the binding agent.

In this embodiment, the fiber forming material may be a thermoplastic material, such as a nylon, that softens when heated. The UV blocking particle may be incorporated into the molten fiber forming material during pre-spinning processing, such as in a single or dual screw extruder, melt pump, etc. For fibers that are prepared from a dope solution, such as Kevlar, the UV blocking particulate may be incorporated by fluid mixing directly into the dope before wet-wet or wet-dry spinning of the fiber.

Examples of commercially available materials used for the components of the UV blocking treatment are provided in Table 1.

TABLE 1

Examples of Some Possible Components of UV Blocking Treatment for Fabrics

| Particle (Mica Based) | Binder |
|---|---|
| Magnapearl (Mearlin ® ) | Rhoplex ® K-3 Emulsion (Rohm & Haas) |
| Lite Super Biue (Mearlin ® ) | Dow Corning ® Fabric Coating 60 (Dow Corning) |
| Micapoly ™ UV Cristal (Centerchem) | Dow Corning ® Fabric Coating 61 (Dow Cornimg) |
| Z-Cote ® (SunSmart) | SM 2658 Emulsion (GE) |
| Z-Cote ® HP1 (SunSmart) | SM 2059 Emulsion (GE) |
| Chroma-lite ® s (Van Dyk) | |
| **Dispersant** | **UV Absorber** |
| DisperBYK ® (BykChemie) | Tinuvin ® 326 (Ciba-Geigy) |
| Pecosil ® PS-100 (Phoenix Chemical) | Tinuvin ® 328 (Ciba-Geigy) |
| | Lowilite ® 26 (Great Lakes Chemical Corp) |
| | Lowilite ® 27 (Great lakes Chemical Corp) |
| | Lowilite ® 20-S (Great Lakes Chemical Corp) |

UV blocking textiles containing particles are illustrated by the following examples. Further objectives and advantages other than those set forth above will become apparent from the examples.

EXAMPLE 1

The fabric used in this example (Q-42901) was composed of an 82% nylon /18% Spandex tricot, 180 grams per meter (g/m) in weight and was obtained from CDA Industries, 26 Channel St., Coburg 3058, Victoria, Australia.

A. Fabric Sample Preparation

The samples of fabric were cut into 6-inch (15.24 cm) by 6-inch (15.24 cm) squares. Each sample was held in a 4-inch (10.16 cm) diameter double embroidery hoop for treatment.

A master fabric treatment batch was prepared by combining acrylic emulsion binder K-3 (Rohm-Haas) (3.35% by weight), dispersion agent BYK-181 (BYK Chemie) (0.20% by weight), and water (96.45% by weight).

Aliquots of the above master batch were separated into portions of 20 to 30 grams. Particulate dispersions for fabric treatment were prepared by mixing individual aliquots with 1% of the dry particulate, by weight of the aliquot, i.e. 0.2–0.3 grams. Moderate agitation was used to wet out the particles, break up aggregations, and disperse the particles.

The following particulate materials, all mica-based, were used: i) $TiO_2$ coated Magnapearl 2000 (Mearle Co.) with particle sizes of 7.8 to 10.9 microns (hereafter referred to as Mica #2); ii) $TiO_2$ coated Magnapearl 4000 (Mearle Co.) with a particle size of 50 microns (hereafter referred to as Mica #4); and iii) $SnO_2$ coated Mearle 9603Z (Mearle Co.) with particle sizes of 6 to 48 microns (hereafter referred to as Mica Z)

The fabric sample to be treated was stretched in a dual hoop and placed face down in a pan. The treatment mixture was then poured onto and through the fabric sample. The fabric sample was allowed to soak for about 30 seconds to one minute, then removed from the pan. Excess fluid was allowed to drip off the sample for about one minute. The treated sample, on the stretch hoop, was then placed in a microwave oven (1450 watts rating) and heated for four minutes, which gave full drying and some additional heating of the treated fabric. The dry sample was then removed from the hoop for evaluation.

B. UV Transmission Evaluation

Samples were measured for UVA and UVB light transmission by DSET, Inc., Phoenix, Ariz. 85027. Hemispherical transmittance measurements were performed on the samples in accordance with ASTM Standard Test Method E903 (1996). The measurements were performed with a Beckman 5240 Spectrophotometer utilizing an integrating sphere. Transmittance measurements were obtained in the spectrum from 150 nm to 400 nm at an incident angle of 7 degrees. The measurements are denoted as being "near-normal/hemispherical spectral transmittance." The UVB region of the spectral data (280 nm to 315 nm) was integrated using 8 wavelength ordinates spaced every 5 nm. The UVA region of the spectral data (315 nm to 400 nm) was integrated using 18 wavelength ordinates spaced every 5 nm.

C. Results

Table 2 shows the results of UV transmission measurements acquired from sample fabrics treated with the three types of mica particulates listed above. Control measurements were acquired from untreated fabric samples. Measurements were taken for each sample in the dry and wet state.

Table I demonstrates that the fabrics treated with the particulate mixtures have UVB and UVA transmission values significantly lower than the transmission values of the untreated fabrics in both the dry and wet states. Each treated fabric reduced the UVB transmission by at least 25% and the UVA transmission by at least 29%. Each treated fabric reduced the transmission of UVA by a greater percentage than it reduced transmission of UVB. The three treated dry-state samples average to a 28% reduction in UVB transmittance and a 35% reduction in UVA transmittance. The three treated wet-state samples average to a 31% reduction in UVB transmittance and a 38% reduction in UVA transmittance. Thus the results suggest that the blocking effect of the added particulate mixture is stronger for fabric when in a wet state than when in a dry state. This is particularly interesting since Table 2 indicates that the untreated Q-42901 fabric blocks less UVB and UVA radiation in the wet state (transmittance=19.9% for UVB, 36.6% for UVA) than in the dry state (transmittance=16.3% for UVB, 26.0% for UVA).

The results indicate that for the Q-42901 fabric in the dry state the Mica Z particulate mixture is a stronger blocker of both UVB and UVA radiation than the other two particulate mixtures. In the wet state, on the other hand, the results indicate that the Mica #2 and Mica Z particulate mixtures have comparable blocking strength, both being greater than the blocking strength of the Mica #4 mixture.

TABLE 2

UVB and UVA Transmission Results[1] for Fabric Q-42901

| Sample | UVB % Trans.[2] | % Trans. Reduction[3] | UVA % Trans.[4] | % Trans. Reduction[5] |
|---|---|---|---|---|
| Dry Samples | | | | |
| Untreated, Dry | 16.3 | — | 26.0 | — |
| Mica #2, Dry | 12.1 | 26 | 18.4 | 29 |
| Mica #4, Dry | 12.2 | 25 | 18.4 | 29 |
| Mica Z, Dry | 10.7 | 34 | 14.9 | 47 |
| Wet Samples | | | | |
| Untreated, Wet | 19.9 | — | 36.6 | — |
| Mica #2, Wet | 13.0 | 35 | 21.8 | 40 |
| Mica #4, Wet | 15.0 | 25 | 24.0 | 34 |
| Mica Z, Wet | 13.3 | 33 | 21.8 | 40 |

[1]These results were determined by DSET, Inc., Phoenix, AZ.
[2]UVB transmittance relative to the UVB transmittance of air.
[3]Reductions for dry samples are calculated relative to the transmission of the dry untreated sample. Reductions for wet samples are calculated relative to the transmission of the wet untreated sample.
[4]UVA transmittance relative to the UVA transmittance of air.
[5]Reductions for dry samples are calculated relative to the transmission of the dry untreated sample. Reductions for wet samples are calculated relative to the transmission of the wet untreated sample.

EXAMPLE 2

The UV transmission through four different fabrics are compared in this example: a buttercup colored nylon/Lycra tricot (Q-42901), a citrus colored nylon/Lycra tricot (Q-32900), a light weight (175 g/m) white single jersey knit cotton (Q-1453), and a heavier weight (200 g/m) white single jersey knit cotton (Q-1587). All fabrics were obtained from CDA Industries, 26 Channel St., Coburg 3058, Victoria, Australia. The samples were prepared in the same manner as in Example 1 using the same three particulate mixtures. UVA and UVB light transmission measurements were made by CDA.

Table 3 shows UV transmission results for the four different fabric samples when untreated (the controls) and when treated with the three particulate mixtures. The UV transmission results are shown in terms of the Ultraviolet Protection Factor (UPF) values for each sample. The mean UPF value is calculated as the UV transmittance of air (100%) divided by the mean UV transmittance of the sample (measured in %). The mean UV transmittance of the sample is calculated as an average of the transmittance values from 280 nm to 400 nm in 5 nm steps.

All four fabrics showed a significant increase in UPF value when treated by the particulate mixtures. UPF values for the treated fabrics ranged from a low of 29.6 for white lighter-weight cotton (Q-1453) treated with MICA #4 to a high of 581 for white heavier-weight cotton (Q-1587) treated with MICA #4.

The effectiveness of the particulate mixtures in improving the UV blocking ability of the fabric was determined by comparing the UPF values of the treated fabrics with the UPF values of the untreated (control) fabrics. This information is presented in the column labeled IMPROVEMENT RATIO. The results indicate that the lighter-weight cotton fabric provides the smallest improvement when treated, showing an increase in blocking enhancement ranging from about 1.2 to 1.4. The heavier-weight cotton fabric provides the largest improvement when treated, showing a blocking enhancement ranging from 1.6 to 7.9. The two nylon/Lycra tricot fabrics provide an improvement between these two extremes, showing a blocking enhancement between 1.35 and 2.25.

The optimal particulate mixture varied with the type of fabric. The greatest enhancement for the heavier-weight cotton and citrus-colored nylon/Lycra fabrics resulted from the MICA #4 mixture. The greatest enhancement for the buttercup-colored nylon/Lycra fabric resulted from the MICA Z mixture. Finally, the greatest enhancement for the lighter-weight cotton fabric resulted from the MICA #2 mixture.

TABLE 3

Ultraviolet Protection Factor (UPF) Values[1] for Different Fabrics

| FABRIC | TYPE | COLOR | PARTICULATE SAMPLE | MEAN UPF[2] | IMPROVEMENT RATIO[3] |
|---|---|---|---|---|---|
| Q-42901 | Lycra-Nylon Tricot | Buttercup | Control | 23.2 | — |
| | | | MICA #2 | 38.4 | 1.66 |
| | | | MICA #4 | 36.7 | 1.58 |
| | | | MICA Z | 44.0 | 1.90 |
| Q-32900 | Lycra-Nylon Tricot | Citrus | Control | 80.5 | — |
| | | | MICA #2 | 157.1 | 1.95 |
| | | | MICA #4 | 180.9 | 2.25 |
| | | | MICA Z | 108.7 | 1.35 |
| Q-1453 | Cotton | White | Control | 24.4 | — |
| | | | MICA #2 | 34.0 | 1.29 |
| | | | MICA #4 | 29.6 | 1.21 |
| | | | MICA Z | 31.2 | 1.28 |
| Q-1587 | Cotton | White | Control | 73.6 | — |
| | | | MICA #2 | 189.6 | 2.58 |
| | | | MICA #4 | 581.5 | 7.90 |
| | | | MICA Z | 120.9 | 1.64 |

[1]Transmission results are from CDA, Coburg, Victoria, Australia.
[2]UPF is the "Ultraviolet Protection Factor," also known as "Sun Protection Factor."
[3]The improvement ratio is the UPF for the treated sample divided by the UPF value for the corresponding untreated (control) fabric.

EXAMPLE 3

The effects of varying the concentration of the UV absorbing particles and the fabric binder on the UV transmission through the buttercup colored nylon/Lycra tricot (Q-42901) are investigated in this example. The samples were prepared in the same manner as in Example 1. Two of the UV absorbing particles from the previous examples, Mica #2 and Mica Z, were investigated, in addition to another mica particle known as Micapoly®UV© Cristal (Centerchem) with a size ranging from 15 to 22 microns (hereafter referred to as Mica UVC).

UVA and UVB light transmission measurements were made using a Philips TL 20W/12 UVB Medical fluorescent lamp as a UV source, and a UVP Radiometer Model 100X with sensors for UVA (Model number UVX-36) and UVB (Model number UVX-30) radiation as a detector. Measurements were made through flat fabric samples with the detector 7.0 cm away from the UV source. Fabric samples were laid directly over the detector to minimize light loss due to scattering, and only light of UVA and UVB wavelengths was measured (no visible light was detectable). Each transmission measurement was taken at least three times to account for statistical fluctuations. The UV transmission results are again given in terms of the Ultraviolet Protection Factor (UPF) values for each sample. The mean UPF value is calculated as the UV transmittance of air (100%) divided by the mean UV transmittance of the sample (measured in %). The mean UV transmittance of the sample is calculated as a weighted average of the UVB (0.946 weighting) and UVA (0.054 weighting) transmittance values. This weighting is used to best represent the relative harmfulness of UVB and UVA radiation to human skin.

Table 4 shows UV transmission results, in the form of UPF values for the Q-42901 fabric when treated with 1% and 2% concentrations of the three UV absorbing particles and 5%, 10%, and 20% concentrations of acrylic emulsion binder. The results indicate that the Mica UVC particles provide the greatest enhancement in UPF value for all particle and binder concentrations. Increasing the UV absorbing particle concentration from 1% to 2% boosts the UPF value between about 15% to 35% for Mica #2, 15% to 130% for Mica Z, and 25% to 100% for Mica UVC. The binder concentration, on the other hand, does not show a systematic influence on UV blocking strength. Some samples (e.g. 1% and 2% Mica #2) have their largest UPF value with the 5% binder concentration, others have their largest value with the 10% concentration (e.g. 2% Mica Z), and still others have their largest value with the 20% concentration (e.g. 2% Mica UVC).

TABLE 4

UPF Values for Fabric Q-42901 Treated With Different UV Absorber and Fabric Binder Concentrations

| | UPF VALUE for Rhoplex RK-3 Binder Concentration | | |
|---|---|---|---|
| UV Absorber | 5% | 10% After | 20% After 20% |
| 1% Mica #2 | 27 | 26 | 19 |
| 2% Mica #2 | 33 | 30 | 26 |
| 1% Mica Z | 28 | 22 | 24 |
| 2% Mica Z | 32 | 50 | 32 |
| 1% Mica UVC | 62 | 67 | 62 |
| 2% Mica UVC | 83 | 83 | 125 |

Table 5 shows UV transmission results, in the form of UPF values, for treated fabrics that have been washed once before the measurements. The results indicate that the Mica UVC particles still provide the greatest enhancement in UPF value after one washing. The influence of binder concentration on UPF value, on the other hand, is much stronger than for unwashed fabrics. All particle types except 1% Mica #2 show a significant increase in UPF value as the binder concentration is increased. For each particle type this increase is larger for the 2% UV absorber concentration than it is for the 1% concentration.

TABLE 5

UPF Values for Fabric Q-42901 Treated With Different UV Absorber and Fabric Binder Concentrations, After One Washing

| UV Absorber | UPF VALUE for Rhoplex RK-3 Binder Concentration 5% | 10% | 20% |
|---|---|---|---|
| 1% Mica #2 | 37 | 31 | 28 |
| 2% Mica #2 | 28 | 36 | 45 |
| 1% Mica Z | 31 | 34 | 37 |
| 2% Mica Z | 29 | 42 | 53 |
| 1% Mica UVC | 55 | 71 | 71 |
| 2% Mica UVC | 59 | 100 | 167 |

UVA and UVB light transmission measurements were made by as described in Example 3.

EXAMPLE 4

Table 6 shows UV transmission results, in the form of UPF values (defined in Example 3), for the Q-42901 fabric when treated with different concentrations of the UV absorbing particles and two different acrylic emulsion binders: Rhoplex RK3 (RK3) and Dow Fibre Coating 60 (DFC 60). Transmission results are provided for the fabric in a dry state before washing, in a dry state after one washing, and in a wet state after two washings.

Further transmission measurements were made for the Q-42901 fabric when in a wet state after two washings. Table 6 shows the results, in the form of UPF values, for the three UV absorbing particles. A second fabric binder, Dow Fibre Coating 60 (DFC 60), was also investigated in addition to Rhoplex RK-3.

The results indicate that the fabric UPF values, after one washing and in a dry state, are generally comparable to their values before washing. The data suggest that the DFC 60 binder provides better UV blocking after washing than the Rhoplex binder. The results also indicate that fabrics treated with a 5% binder concentration lose some UV blocking ability when in a wet state after two washings. Those fabrics treated with a 20% binder concentration, on the other hand, show an enhancement in UV blocking ability after washing.

TABLE 6

UPF Values for Fabric Q-42901 Before and After Washings

| Particle | Binder | UPF Value for DRY Unwashed | DRY After 1 Wash | WET After 2 Washes |
|---|---|---|---|---|
| 1% Mica UVC | 5% RK-3 | 62 | 55 | 67 |
| " | 10% RK-3 | 67 | 71 | 91 |
| " | 20% RK-3 | 62 | 71 | 143 |

TABLE 6-continued

UPF Values for Fabric Q-42901 Before and After Washings

| Particle | Binder | UPF Value for DRY Unwashed | DRY After 1 Wash | WET After 2 Washes |
|---|---|---|---|---|
| " | 5% DFC 60 | 91 | 45 | 37 |
| " | 10% DFC 60 | 71 | 52 | 59 |
| " | 20% DFC 60 | 125 | 111 | 167 |
| 2% Mica UVC | 5% RK-3 | 83 | 59 | 67 |
| " | 10% RK-3 | 83 | 100 | 250 |
| " | 20% RK-3 | 125 | 167 | 333 |
| 1% Mica #2 | 5% RK-3 | 32 | 29 | 28 |
| " | 20% DFC 60 | 37 | 45 | 55 |
| 2% Mica #2 | 10% DFC 60 | 36 | 38 | 50 |
| 2% Mica Z | 10% RK-3 | 50 | 42 | 34 |
| " | 20% RK-3 | 32 | 53 | 83 |

Further transmission measurements have been made for the Q-42901 fabric when in treated with a 1% concentration of pure Titanium Dioxide ($TiO_2$). Table 7 shows the results, in the form of UPF values, for three concentrations of fabric binder. The data indicate that the UV blocking ability decreased with increased binder concentration. The UV blocking ability increased, however, for all three samples after washing.

TABLE 7

UPF Values for Fabric Q-42901 Treated with 1% $TiO_2$ Before and After Washing

| | UPF Value for Unwashed | Washed |
|---|---|---|
| 5% Rhoplex RK-3 | 26 | 38 |
| 10% Rhoplex RK-3 | 21 | 26 |
| 20% Rhoplex RK-3 | 19 | 32 |

EXAMPLE 5

In order to reduce effects such as surface whitening, dulling, and stiffening of materials, it is helpful to keep the concentration of the UV absorbing particles as low as possible. Table 8 demonstrates that UPF values of 100 or more can be achieved while using a MICA UVC concentration of 0.5%. The light-weight cotton is the only fabric for which a greater concentration is needed to result in a UPF of 100 or greater. Table 8 also shows that the blocking ability of some treated fabrics may depend upon which side of the fabric the UV absorbing mixture is poured.

TABLE 8

UPF Values for Fabrics Treated With MICA UVC and DFC 60

| Material | Type | Weight (g/m) | UPF Value at % MICA UVC/% DFC 60 Untreated | 0.1/20 | 0.5/20 | 1.2/9 |
|---|---|---|---|---|---|---|
| Cotton | 1453 | 175 | 22 | — | 77 | — |
| " | 1587 | 200 | 59 | — | 250 | — |
| Nylon-Lycra | Gold[1] | 180 | 25 | 38 | 100 | 125 |
| " | Gold[2] | 180 | 25 | 33 | 42 | 53 |
| " | Midori | 180 | 77 | — | 143 | — |
| " | White | 180 | 143 | — | 670 | — |

TABLE 8-continued

UPF Values for Fabrics Treated With MICA UVC and DFC 60

| Material | Type | Weight (g/m) | Untreated | UPF Value at % MICA UVC/% DFC 60 0.1/20 | 0.5/20 | 1.2/9 |
|---|---|---|---|---|---|---|
| " | Black | 180 | 167 | — | 417 | — |

[1]Particulate mixture applied from the "shiny" side.
[2]Particulate mixture applied from the "dull" side.

EXAMPLE 6

Table 9 shows the UV blocking properties of three fabrics which were treated with a Micapoly UV Crystal (Mica UVC) particulate mixture (particle sizes ranging from 15 to 22 microns) with a DFC 60 binder.

TABLE 9

UPF Values for Washed and Unwashed Treated[1] Fabrics

| Material | UPF Values for Unwashed | Washed |
|---|---|---|
| Midori Nylon-Lycra | 102 | 156 |
| White Cotton, 175 g/m | 29 | 72 |
| White Cotton, 200 g/m | 85 | 200 |

[1]Treated with MICA UVC and DFC 60 binder.

EXAMPLE 7

In another example, the treating suspensions also included an additional UV blocking material, not necessarily particulate, which would either be soluble in the aqueous suspension or insoluble and suspended. Hence, two separate UV absorbers, Tinuvin® 328 and Lowilite® 20-S were added to a suspension of the Micapoly®UV Crystal, Mica UVC, in DFC 60 made according to Example 1. Samples of both cotton and a nylon/Lycra material were treated with suspensions containing either the Mica UVC and the absorber or the absorber alone and also the Mica UVC alone Results for the UPF after washing the samples were as given in Table 10.

TABLE 10

Effect of Adding Molecular UV Absorbers into the Particulate Suspensions

| UV Absorber Content | UPF Value for Cotton | nylon/Lycra |
|---|---|---|
| Mica UVC | 62 | 43 |
| Mica UVC + Tinuvin ® 328 | 77 | 40 |
| Tinuvin ® 328 | 83 | 53 |
| Mica UVC + Lowilite 20-S | 77 | 111 |
| Lowilite 20-S | 42 | 167 |

It does appear that the use of a molecular absorber is very selective on the overall system. For some cases there is no improvement, e.g. with cotton. However, with nylon/Lycra, one type of UV absorber (Lowilite 20-S) did show some improvements alone with a lesser effect when the Mica UVC was incorporated.

EXAMPLE 11

This example illustrates the use of a method of applying the suspension to the fabric using a spray. According to this example, an aqueous suspension was prepared consisting of 0.5% by weight of Mica UVC and 10% by weight of the binder, SM 2059. The suspension was contained in a bottle fitted with a manual spray head and the suspension was sprayed onto a sheet of cotton fabric, weight 200 g/meter, until an even covering was formed. The cotton sheet was allowed to dry at room temperature overnight. The dry sheet had a hand very similar to the untreated cotton material. Measurements were made of UV transmission for the wet and dry material. Results for the UPF values were 400 for the dry and 290 for the wet cotton sheet.

EXAMPLE 12

This example provides a typical method by which a consumer could apply UV absorbing particles according to the present invention to a finished garment. A suspension concentrate was prepared by mixing, in order, Mica UVC, Pecosil PS 100, and Dow Fabric Coating-60 in a 1:1.5:10 weight ratio. This mixture was stored until use in a sealed container. At the time of use, the viscous mixture was diluted with water to provide an aqueous suspension (87.5% by weight in resulting suspension). A finished article of clothing in the form of a 100% cotton tee-shirt, of medium weight, was immersed in the aqueous suspension and then allowed to drip/drain free of excess suspension. The tee-shirt was dried overnight at room temperature on a hanger. The dry treated tee-shirt had an UPF value of 380 compared to 80 for the untreated tee-shirt.

EXAMPLE 13

This example illustrates the use of colored UV blocking particles for the preparation of a UV blocking fabric. Hence a suspension was prepared as per Example 1 using an aqueous suspension comprising 1% by weight of Chroma-lite® Light Blue, 1.5% by weight of Pecosil PS 100, and 10% by weight of Dow Fabric Coating 60. A midori (light blue) colored nylon/Lycra material, weight 180 g/meter, was treated with 20 g. of the suspension to a 4 inch×4 inch piece of the material. The dried material was washed using a mild detergent and then dried. The UV transmission of the material was measured at over 140 UPF compared to 767 for the untreated material. Additionally the appearance of the material was not changed in that the particles were not observable.

EXAMPLE 14

This example demonstrates the simultaneous coloring and UV blocking of a material. Suspensions of a series of particulate suspensions were made from the Chroma-lite® materials as in Example 13. Samples of a white cotton material of weight 200 g/meter were treated with each suspension as per Example 13. The appearance and UV transmission of the finished materials are given in Table 11.

TABLE 11

Effect of Treating a White Cotton Material with Colored Particulates

| PARTICULATE MATERIAL | UPF | APPEARANCE |
|---|---|---|
| Chroma-Lite Light Blue | 200 | Even mixed blue/white color |
| Chroma-Lite Dark Blue | 250 | Pale blue color |
| Chroma-Lite Black | 200 | Even gray color |
| Chroma-Lite Pearl Glo SF-UVR | 220 | Bright White color |

While the present invention is disclosed by reference to the preferred embodiments and examples detailed above, it is to be understood that these examples are intended in an illustrative rather than limiting sense, as it is contemplated that modifications will readily occur to those skilled in the art, which modifications will be within the spirit of the invention and the scope of the appended claims.

What is claimed is:

1. An article comprising a fabric, silicate mineral particles, and a binder binding the silicate mineral particles to the fabric.

2. An article according to claim 1 wherein the fabric is woven.

3. An article according to claim 1 wherein the fabric is not woven.

4. An article according to claim 1 wherein the fabric comprises cotton.

5. An article according to claim 1 wherein the fabric is selected from the group consisting of polyesters, nylons, acrylics, acetates, Dacron, Lycra, Spandex, rayon, wool, silk, polyethylene, and polypropylene.

6. An article according to claim 1 wherein the fabric comprises an article of clothing.

7. An article according to claim 1 wherein the fabric comprises a form selected from the group consisting of an awning, an umbrella, a tent, a tarp, a sun screen and a canvas.

8. An article according to claim 1 further including a pigment to impart color to the silicate mineral particles.

9. An article according to claim 1 further including metallic particles mixed with the silicate mineral particles, and wherein the binder binds both the metallic particles and the silicate mineral particles to the fabric.

10. An article according to claim 9 wherein the metallic particles comprise titanium dioxide.

11. An article according to claim 1 wherein the binder is selected from the group consisting of casein isolate, soy protein isolate, starch, starch derivatives, gums, natural rubber, and synthetic latexes.

12. An article comprising a fabric, mica-containing particles, and a binder binding the mica-containing particles to the fabric.

13. An article according to claim 12 wherein the fabric is woven.

14. An article according to claim 12 wherein the fabric is not woven.

15. An article according to claim 12 wherein the fabric comprises cotton.

16. An article according to claim 12 wherein the fabric is selected from the group consisting of polyesters, nylons, acrylics, acetates, Dacron, Lycra, Spandex, rayon, wool, silk, polyethylene, and polypropylene.

17. An article according to claim 12 wherein the fabric comprises an article of clothing.

18. An article according to claim 12 wherein the fabric comprises a form selected from the group consisting of an awning, an umbrella, a tent, a tarp, a sun screen and a canvas.

19. An article according to claim 12 further including a pigment to impart color to the mica-containing particles.

20. An article according to claim 12 further including metallic particles mixed with the mica-containing particles, and wherein the binder binds both the metallic particles and the mica-containing particles to the fabric.

21. An article according to claim 20 wherein the metallic particles comprise titanium dioxide.

22. An article according to claim 12 wherein the binder is selected from the group consisting of casein isolate, soy protein isolate, starch, starch derivatives, gums, natural rubber, and synthetic latexes.

23. A method of manufacturing comprising the steps of providing a fabric, providing silicate mineral particles, providing a binder, and applying the silicate mineral particles with the binder to the fabric, whereby the silicate mineral particles become bound to the fabric.

24. A method according to claim 23 wherein the applying step includes emersing the fabric in a suspension comprising the silicate mineral particles and the binder.

25. A method according to claim 23 wherein the applying step includes spraying the fabric with a suspension comprising the silicate mineral particles and the binder.

26. A method of manufacturing comprising the steps of providing a fabric, providing mica-containing particles, providing a binder, and applying the mica-containing particles with the binder to the fabric, whereby the mica-containing particles become bound to the fabric.

27. A method according to claim 26 wherein the applying step includes immersing the fabric in a suspension comprising the mica-containing particles and the binder.

28. A method according to claim 26 wherein the applying step includes spraying the fabric with a suspension comprising the mica-containing particles and the binder.

* * * * *